US005096077A

United States Patent [19]

Odet et al.

[11] Patent Number: 5,096,077

[45] Date of Patent: Mar. 17, 1992

[54] STOPPERING DEVICE NON-REMOVABLY ATTACHED TO THE NECK OF A CONTAINER

[75] Inventors: Philippe Odet, Chasselay; Jacques Ambrosi, Villefranche Sur Saone, both of France

[73] Assignee: Astra Plastique, France

[21] Appl. No.: 735,913

[22] Filed: Jul. 25, 1991

[30] Foreign Application Priority Data

Jul. 25, 1990 [FR] France ..... 90 09720

[51] Int. Cl.[5] ..... B65D 55/02

[52] U.S. Cl. ..... 215/211; 215/28; 215/216; 215/224; 215/235; 215/263; 215/320

[58] Field of Search ..... 215/28, 29, 204, 211, 215/213, 224, 225, 235, 263, 237, 238, 320, 355, 364

[56] References Cited

U.S. PATENT DOCUMENTS

| | | | |
|---|---|---|---|
| 4,029,231 | 6/1977 | Jonsson | 215/256 |
| 4,387,818 | 6/1983 | Conti | 215/256 |
| 4,629,081 | 12/1986 | McLaren | 215/206 |
| 4,718,567 | 1/1988 | La Vange | 215/216 |
| 4,759,455 | 7/1988 | Wilson | 215/206 |
| 4,776,475 | 10/1988 | La Vange | 215/216 |
| 4,782,964 | 11/1988 | Poore et al. | 215/216 |
| 4,974,735 | 12/1990 | Newell et al. | 215/253 |
| 5,046,630 | 9/1991 | Schneider et al. | 215/321 |

FOREIGN PATENT DOCUMENTS

| | | |
|---|---|---|
| 0316269 | 5/1989 | European Pat. Off. . |
| 1486483 | 5/1967 | France . |

*Primary Examiner*—Stephen Marcus
*Assistant Examiner*—Vanessa Caretto
*Attorney, Agent, or Firm*—Oliff & Berridge

[57] ABSTRACT

A stoppering device non-removably attached to the flanged neck of a container has a base (8) projecting beyond the neck of the container, with at least two arcuate surface sections extending from the base and disposed along a circle having a diameter slightly greater than that of the outer surface of the flanged neck (5). Each arcuate surface section (16) is extended on at least one of its sides in the circumferential direction by a locking foot (17). Each foot is integral with the arcuate surface at the end of the section opposite to the base (8) and is inclined inward from the end integral with the arcuate surface section (16) to a free end of the foot located toward the base (8). Each foot abuts the flanged neck (5) and holds the stoppering device securely onto the container.

15 Claims, 2 Drawing Sheets

STOPPERING DEVICE NON-REMOVABLY ATTACHED TO THE NECK OF A CONTAINER

BACKGROUND OF THE INVENTION

The subject of the present invention is a stoppering device non-removably attached to the neck of a container.

The device according to the present invention is intended to be coupled to a container in which the neck of the container has a peripheral flange projecting from its outer wall. The stoppering device has a base intended to permanently cover an opening in the neck, the base itself having an opening for the passage of the products containing in the container and blockable by a cap or the like.

In certain applications, a stoppering device must provide good protection against initial opening to safeguard the products contained in the container. Likewise, a stoppering device must not be able to be pulled off the container upon which it is mounted, even after the latter has been emptied, to avoid the risk of refilling the container with an unsuitable product.

SUMMARY OF THE INVENTION

An object of the present invention is to provide a stoppering device which not only protects against opening and prevents removal but also can be made of synthetic material, using molds with a simple structure and without posing any unmolding problems.

For this purpose, the device according to the present invention has a base projecting beyond the neck of the container to which the stoppering device is secured, with at least two sections extending from one side of the base having arcuate surfaces and being disposed in a circle having a diameter slightly greater than that of the external face of a flange on the neck of the container. Each arcuate section is extended on at least one of its sides in the circumferential direction by a resilient foot which is integral with an end of the arcuate section opposite the base and is inclined toward the container from the end integral with the portion of the arcuate section to a free end located toward the base. The free ends of the feet abut the flange on the neck of the container and lock the stoppering device to the container.

BRIEF DESCRIPTION OF THE DRAWINGS

The invention will be clearly understood with the aid of the following description with reference to the drawings attached showing, as a nonlimitative example, one embodiment of this stoppering device.

DETAILED DESCRIPTION OF PREFERRED EMBODIMENTS

Figure 1:
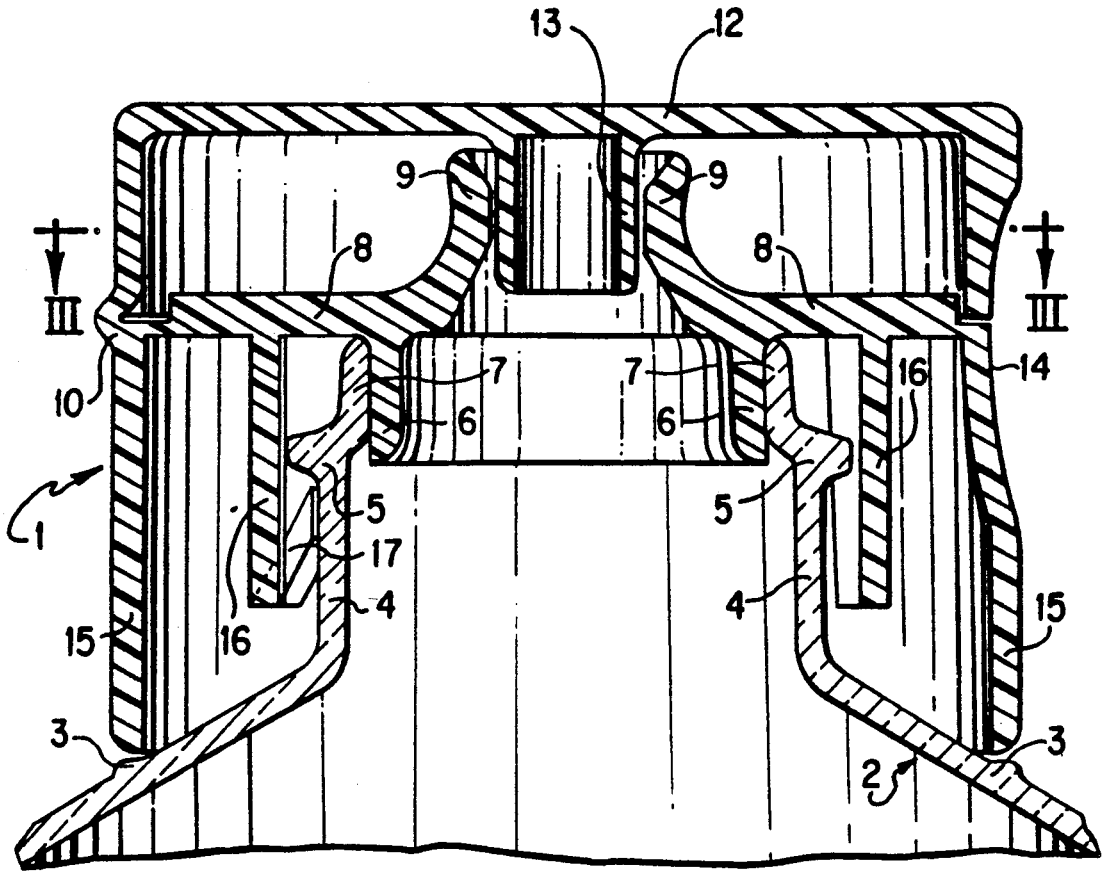
FIG. 1 is a longitudinal section of the stopper in accordance with the present invention, in the closed position and mounted on the neck of a container, taken along line I—I in FIG. 3.

The stoppering device according to the present invention is intended to be secured to a container of any material having a neck with a flange or bead protruding from the outer surface of the neck.

The stoppering device includes a ring-shaped base with an opening in the center thereof. The opening is bounded by a chimney-shaped part protruding from a first side of the base, for securement into the neck of the container, and a tubular part or spout protruding from a second, opposite side of the base. A cup-shaped cap is hinged to the edge of the base and has an integral stopper protruding from its inside to fit within the spout when snapped over the second side of the base. A plurality of arcuate sections extend from the first side of the base and define an annular groove with the chimney-shaped part for receiving the neck of the container. A side of each arcuate section has a resilient foot integrally coupled thereto, which is inclined inward and toward the spout, for snapping over the flange on the neck of the container. Once assembled, the feet lock under the flange and the stoppering device is permanently secured to the container. Additionally, an outer skirt, concentric with the arcuate sections, extends from the edge of the first side of the base and prevents access to the locking feet.

According to one characteristic of the invention, the height of each foot is essentially the same as about half the height of one arcuate surface section.

The distance between the free ends of the feet from the base gives the feet free play, which not only facilitates the mounting conditions of the device but also the unmolding conditions thereof.

Advantageously, the angle which each foot forms with a perpendicular to the base of the stoppering device is less than about 45°, preferably about 25°. This value favors conditions for both pushing or deflecting the feet outward when passing over the flange and holding the abutting position of the feet that ensures the grip of the device on the neck of the container.

According to another characteristic of the invention, the various pairs of arcuate surface sections and locking feet are arranged in a regular angular distribution. The number of pairs of arcuate surface sections and locking feet is a function of the height of the stoppering device, and may be three, four or five, for example.

Preferably, this device has a cylindrical skirt projecting from the base outside the pairs of arcuate surface sections and locking feet, with a length at least equal to the arcuate surface sections and with its free edge located in the immediate vicinity of the body of the container.

The cylindrical skirt, which totally covers the pairs of arcuate surface sections and locking feet, prevents any access to the locking feet in such a way that a user cannot use a tool to exert a deforming action on the feet and the arcuate surface sections associated with them to cause the feet to come loose from the flange.

After the stoppering device has been manufactured, it is fitted onto the neck of the container. The base is pressed onto and over the neck of the container into securement. During assembly, the feet contact a flange on the neck of the container and are pushed back and outward. After passing over the flange, the feet snap or bounce back toward the neck due to the resiliency of the material of the feet and the integral connection. When the stoppering device is fully mounted on the neck of the container, the chimney-shaped part fits within the neck of the container and the several feet abut the underside of the flange which circumscribes the neck. It then becomes impossible to remove the stoppering device except by destroying its locking feet.

The stoppering device according to the invention is advantageously made of a polymer, such as polyethylene, polypropylene or polystyrene.

FIG. 1 shows the upper part of a container 2, especially the shoulder 3 and the neck 4 thereof with opening 7. The cylindrical neck 4 of the container is provided with an annular flange 5 located adjacent the neck end and projecting from its outer surface.

The stoppering device 1, made of synthetic material, has an annular chimney-shaped part or ring 6 designed to fit in sealing engagement within the opening 7 of the neck 4. This chimney-shaped part 6 projects from one side of an annular ring-shaped base 8 which abuts the upper edge of the neck. From the other side of the base 8, a constricted tubular part 9 projects, forming a pouring spout. Coupled to a portion of the outer edge of the base 8, there is an articulated, hinged cap 12 having a hollow tubular stopper 13 intended to fit into the spout or part 9 to ensure fluid-tight closure of the stoppering device. The cap 12 is articulated by conventional means, for example, a film hinge 10, and fully covers one side of the base 8. The cap 12 has a recess 14 in its front face that facilitates opening.

The base 8 is extended on the side opposite cap 12 by a cylindrical skirt 15 which extends from the outer edge of the base 8 down to the level of the shoulder 3 of the container 2.

Figure 2:
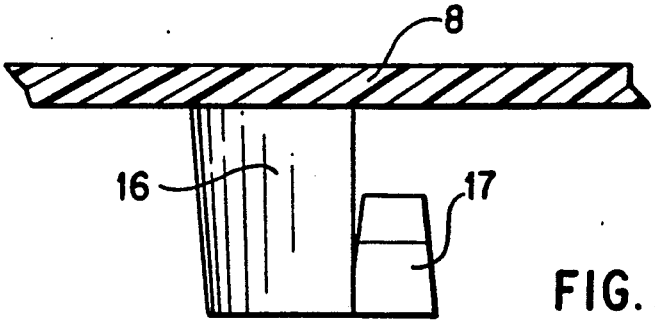
FIG. 2 is a section through the base of the device and a side elevation of the inside of an arcuate surface section and a locking foot, on an enlarged scale.
Figure 3:
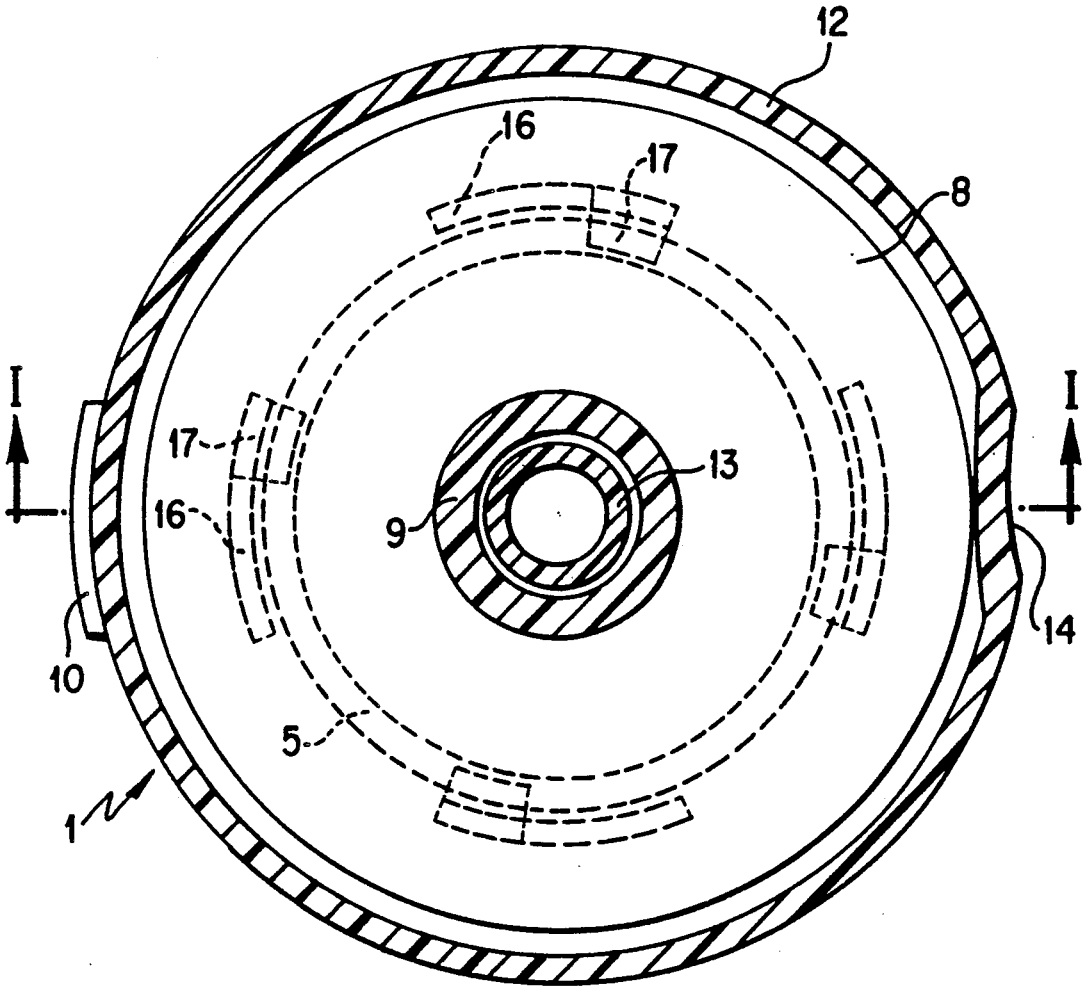
FIG. 3 is a cross section through the device along line III—III in FIG. 1.

The base 8 also has four arcuate surface sections 16 offset 90° from one another and projecting from the same side as the skirt 15 and the chimney-shaped part 6. The skirt 15, arcuate surface sections 16 and chimney-shaped part 6 are concentric and extend generally parallel to each other, with the chimney-shaped part 6 and arcuate surface sections 16 defining an annular groove therebetween for receiving the neck of the container. p Each arcuate surface section 16 is extended on one of its sides in the circumferential direction by a locking foot 17 integral with the end of the arcuate section opposite to the base 8. The connection between the arcuate section and the locking foot is an integral hinge. The foot 17, also arcuately-shaped, is inclined inward from the end integral with the arcuate surface section to a free end located toward the base 8. The free end of each foot is beveled, as seen in FIGS. 1 and 2.

It can be seen from FIG. 1 that the height of each foot 17 is essentially less than the height of the arcuate surface sections 16. The height of each foot 17 is such that it can rest beneath the flange 5 of the neck 4. The angle that each foot forms with a perpendicular to the base 8 is less than about 45°, and preferably about 25°.

In practice, the stoppering device 1 is positioned against the neck of the container and attached thereto by a simple pushing and snapping action, with the feet 17 deflecting outward as they come in contact with the flange 5 and the chimney-shaped part 6 fitting within the opening 7 in sealing engagement. Due to their resiliency, the feet 17, after having passed over the flange 5, resume their initial position and abut and press against the flange 5, ensuring attachment in a definitive non-removable fashion of the device to the neck of the container. It should be pointed out that it is not possible to pull the device off the neck of the container without breaking the locking feet. In addition, the locking feet 17 cannot be moved to allow the stoppering device 1 to be pulled off the container 2 since the feet 17 are rendered inaccessible by the presence of the cylindrical skirt 15.

It can be seen from the above description that the invention provides a considerable improvement to the prior art by supplying a stoppering device of simple design, which is attached in an irreversible, non-removable fashion to the neck of the container for which it is intended.

Of course, the invention is not limited to the single embodiment of this device described above as an example; on the contrary, it includes all alternative embodiments. Thus, for example, each arcuate surface section could be equipped with two locking feet provided on both sides, the number of arcuate surface sections could be other than four, or the stoppering device could be stoppered by an element other than a hinged cap without departing from the scope of the invention. Various modifications may be made without departing from the spirit and scope of the invention as defined in the appended claims.

What is claimed is:

1. A stoppering device for non-removable attachment to the neck of a container having a peripheral flange, comprising:

a base having an opening of passage of products contained in the container;

at least two arcuate sections projecting from said base and generally disposed in a circle, each said arcuate section having an end; and at least two resilient locking feet, each having a free end and each being integrally coupled to a side of one of said arcuate sections in a circumferential direction at said end and inclined inward from said arcuate section to said free end toward said base, said base being adapted to fit over the neck and said ends being adapted to abut the flange of the neck.

2. A stoppering device according to claim 1, wherein each said foot has a height generally equal to half a height of said arcuate surface section.

3. A stoppering device according to claim 1, wherein each said foot forms an angle with a perpendicular to said base of less than about 45°.

4. A stoppering device according to claim 3, wherein said angle formed by each said foot with the perpendicular to said base is about 25°.

5. A stoppering device according to claim 1, wherein said at least two arcuate sections comprise pairs of arcuate sections arranged in a regular angular distribution.

6. A stoppering device according to claim 1, further comprising a cylindrical skirt projecting from said base, outside said arcuate sections and locking feet, with a length at least equal to a length of said arcuate sections and having a free edge located in the immediate vicinity of a body of the container.

7. A stoppering device according to claim 6, wherein said cylindrical skirt and said arcuate sections are concentric.

8. A stoppering device according to claim 1, wherein said feet are integrally hinged to said arcuate sections at said ends and said free ends deflect outwardly.

9. A stoppering device according to claim 1, wherein each said foot has a beveled surface on said free end.

10. A stoppering device according to claim 1, further comprising an annular ring extending from said base substantially parallel to and within said arcuate sections for insertion into the neck of the container.

11. A stoppering device according to claim 1, further comprising a spout extending from said base in a direction opposite to said arcuate sections.

12. A stoppering device according to claim 1, further comprising a cap is hingedly coupled to said base.

13. A stoppering device according to claim 1, further comprising a stopper for plugging the neck of the container.

14. A stoppering device according to claim 1, wherein said arcuate sections are resilient.

15. A stoppering device according to claim 1, wherein said stoppering device is made of polymer.

* * * * *